US005709276A

United States Patent [19]

Lee

[11] Patent Number: 5,709,276

[45] Date of Patent: Jan. 20, 1998

[54] MULTI-POSITION DIRECTIONAL DRILL

[75] Inventor: Douglas W. Lee, Wichita, Kans.

[73] Assignee: Straightline Manufacturing, Inc., Newton, Kans.

[21] Appl. No.: 621,156

[22] Filed: Mar. 21, 1996

[51] Int. Cl.[6] ..... E21B 7/02; E21B 15/04

[52] U.S. Cl. ..... 175/122; 173/185; 173/192; 175/162

[58] Field of Search ..... 175/61, 122, 162; 173/28, 184, 185, 192

[56] References Cited

U.S. PATENT DOCUMENTS

| | | | |
|---|---|---|---|
| 3,744,574 | 7/1973 | Carley | 173/28 X |
| 5,213,169 | 5/1993 | Heller | 175/122 |
| 5,226,488 | 7/1993 | Lossard et al. | 175/61 |

*Primary Examiner*—David J. Bagnell
*Attorney, Agent, or Firm*—Edward L. Brown, Jr.

[57] ABSTRACT

A horizontal directional boring machine pivotally mounted to a tractor about a vertical axis of rotation positioned over a common entry point into the ground which permits multiple direction bores which radiate from said common entry point all with a single set-up of the boring machine.

7 Claims, 2 Drawing Sheets

MULTI-POSITION DIRECTIONAL DRILL

BACKGROUND OF THE INVENTION

This invention relates to horizontal directional boring machines and more specifically to a drilling machine mounted on a tractor which is specifically designed to allow multiple bores with a single set-up of the machine.

Guided horizontal boring machines are a new field of technology which is replacing conventional trenching machines for the placement of utility lines such as electricity, telephone, water and gas. The conventional manner to install or replace these utility lines was with conventional trench digging equipment where a ditch is first dug in the area where the line is desired. The utility line is then installed and the ditch is covered. Directional drilling equipment in many applications have eliminated trenching completely. These guided drilling machines can bore along a straight or curved path at a desired depth and reach an end point within two feet of its desired location. Replacement and retrofit construction of underground utility services in urban and suburban areas is a large application for this technology. The steering capability of horizontal boring machines over a variable path is achieved by various types of drilling heads which in turn use both hydraulic forms of cutting as well as mechanical cutting with hardened bits or a combination of both.

Some of the early directional boring machines operated down-hole tools from an umbilical-supplied power source through hoses and electrical wires. In the early 1960's, ATT Bell Laboratories developed an umbilical-type boring device, also referred to as a percussion or impact mole which was powered by pressurized fluids and electrical lines trailing the tool. The type of directional drilling which evolved to the present state of the art is a string of flexible drill rod tubing controlled on the surface by a drilling frame which applies thrust for lineal movement and rotational torque for cutting along with pressurized jets. The directional boring machines which are currently on the market are all of the "drill string" type with drill frames on the surface which apply thrust and rotation for guiding the drill string and hydraulic pressure in the case of hydraulic cutting tools. A typical drilling frame of this type is shown in U.S. Pat. No. 5,253,721 which teaches a drilling head which utilizes hydraulic jets along with the hardened cutting blades for a combination mechanical and hydraulic cutting and a inclined surface behind the cutting blade for directional guiding of the drill string.

SUMMARY OF THE INVENTION

The drilling rack of the present invention is very similar in function and structure to that shown in the last-mentioned '721 patent. In fact, once the drilling bore is commenced, its function will be identical with that of the FIG. 8 drilling frame shown in the '721 patent.

Each time a conventional drilling frame drills a bore, it must be set up with its anchor stakes placed in the ground and its support pads properly positioned. Once the first bore is completed, the drill frame with its anchor stakes and support pads must be removed and this heavy machine must be manually repositioned for the next bore and then restaked to the ground before the bore commences. This set-up time can be up to an hour in duration and with many short bores, the set-up time can severely limit the drilling machines' daily capacity. The present invention provides a tractor or some other type of movable base which supports the drilling rack in a cantilevered manner so the drilling rack may rotate horizontally about a pivotable joint with the tractor which pivotal joint is positioned directly over the drill string entry point of the ground. In a particular application where a series of bores radiate out from a trunk line, the drilling machine can be positioned directly over that juncture point with a single set-up of the anchor stakes on the tractor with the drill frame free to rotate in a horizontal plane thereby allowing a plurality of bores to be made with a single set-up. The drill rack will easily rotate and be capable of drilling an unlimited number of bores within an arc of 180°, all of which radiate out from a single juncture point with the trunk line. The tractor on which the drill frame is mounted is a self-contained unit which provides hydraulic pressure for powering the drill frame as well as drilling fluid under pressure for cutting the bore. The stake-down arrangement of the tractor does not require that any of the stakes be removed to accomplish these multiple bores nor does the retractable rear foot create any problem prior to rotating to a new position. All of the various alternate drilling positions will intersect a common entry point on the ground.

Initially, the drill frame can be tilted vertical with a large diameter auger bit in place for digging a shallow entry pit. After the entry pit is dug, the auger bit is removed and the drill frame is tilted from its vertical position back to whatever angular position with the ground is desired. Since the pivot point of the drill frame is directly over the entry pit, any rotation of the drill frame at its pivoted joint will cause the drill string axis to intersect with the pivoting joint axis just below the surface of the ground so that all of the multiple bores will intersect with the entry pit.

Therefore, the principal object of the present invention is to provide a drilling frame which can provide multiple bores radiating from a common point without moving the anchors of the drill unit.

Another object of the present invention is to provide a drilling unit having a drill frame mounted thereon which freely rotates about a common entry point for the multiple bores.

DESCRIPTION OF THE PREFERRED EMBODIMENT

Figure 1:
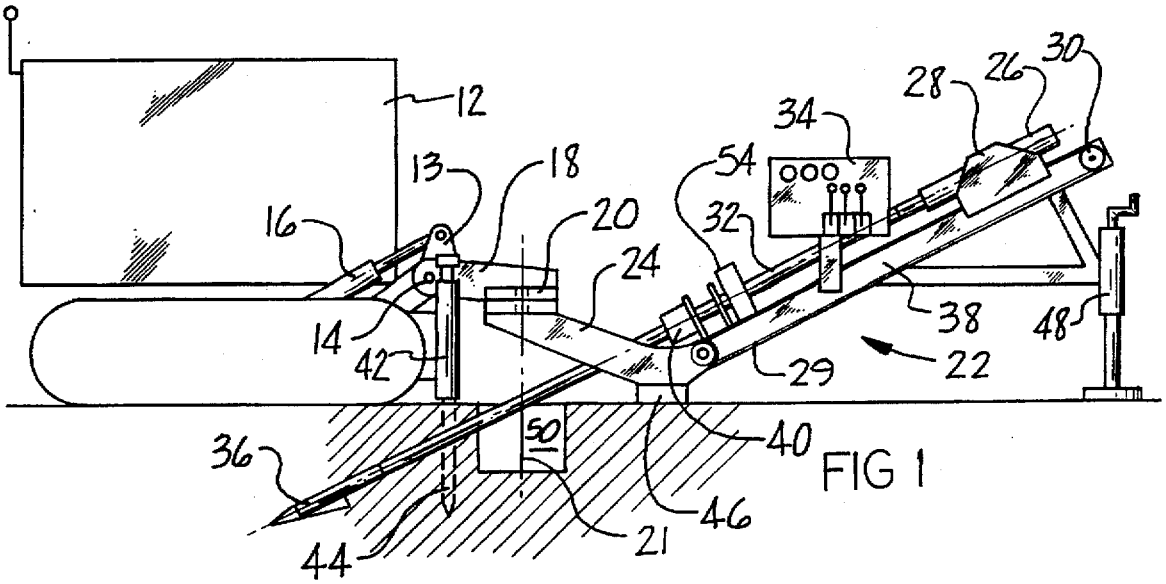
FIG. 1 is a symbolic side elevational view of the drilling machine with the drill frame in its angular drilling position.

FIG. 1 symbolically illustrates the drilling machine generally identified by reference numeral 10.

Figure 2:
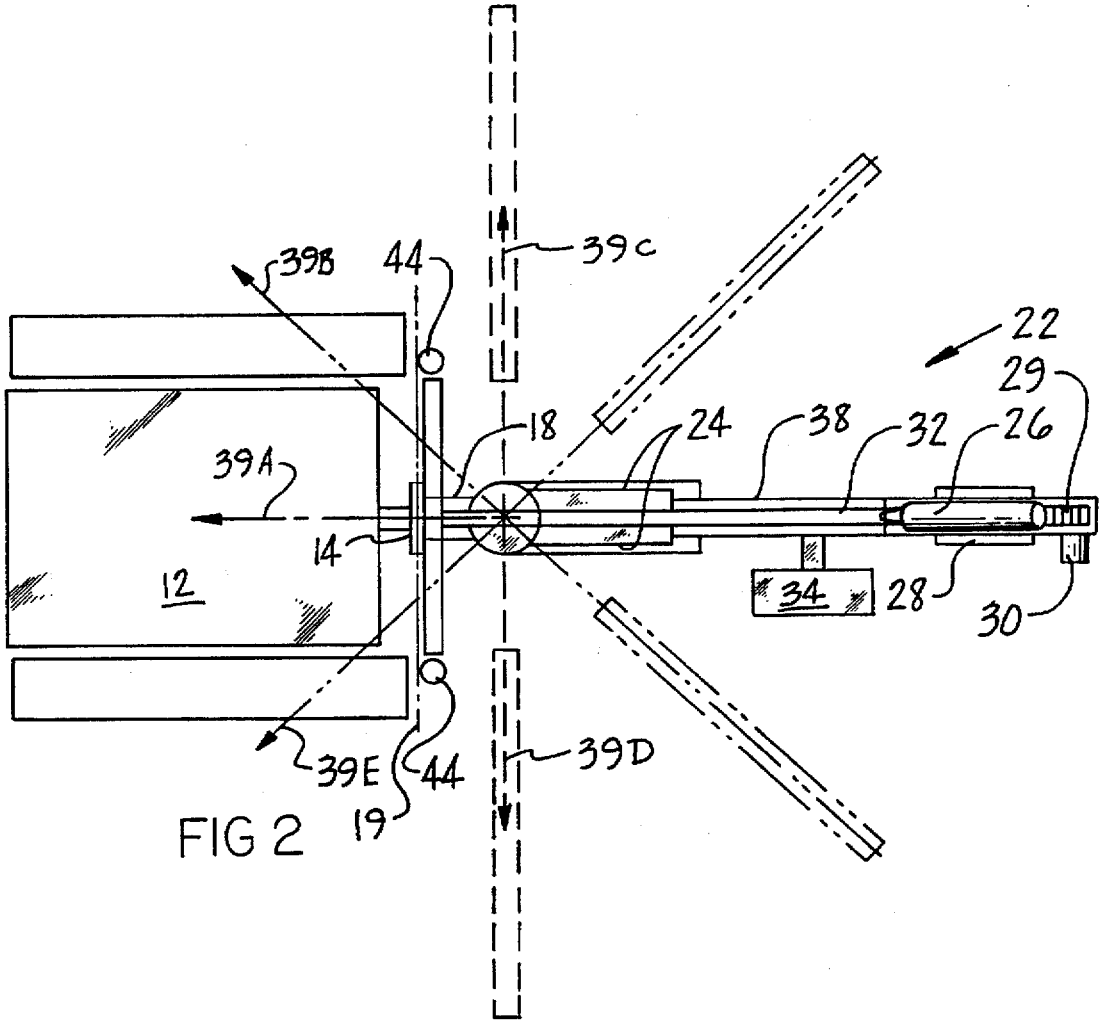
FIG. 2 is a top view of the drilling machine with alternate positions of the drill frame shown in dotted line.

The machine includes a drill frame 22 which is supported on a tractor 12. Pivotally mounted on the front frame of the tractor is a tilting arm 18 which pivots on the tractor about pivot pin 14. Also attached to the tractor 12 is a double acting hydraulic cylinder 16 with its rod end connected to the arm 18 through a crank 13. Arm 18 supports a pivoting joint 20 which has a vertical axis of rotation 21 in the FIG. 1 position. Tilting arm 18 pivots about a horizontal axis 19 as seen in FIG. 2. Pivoting joint 20 joins with a pair of support legs 24 which extend downward and directly attach to the drill frame 22. Legs 24 are bifurcated, as seen in FIG. 2, to permit the passage of the drill string 32.

Figure 3:
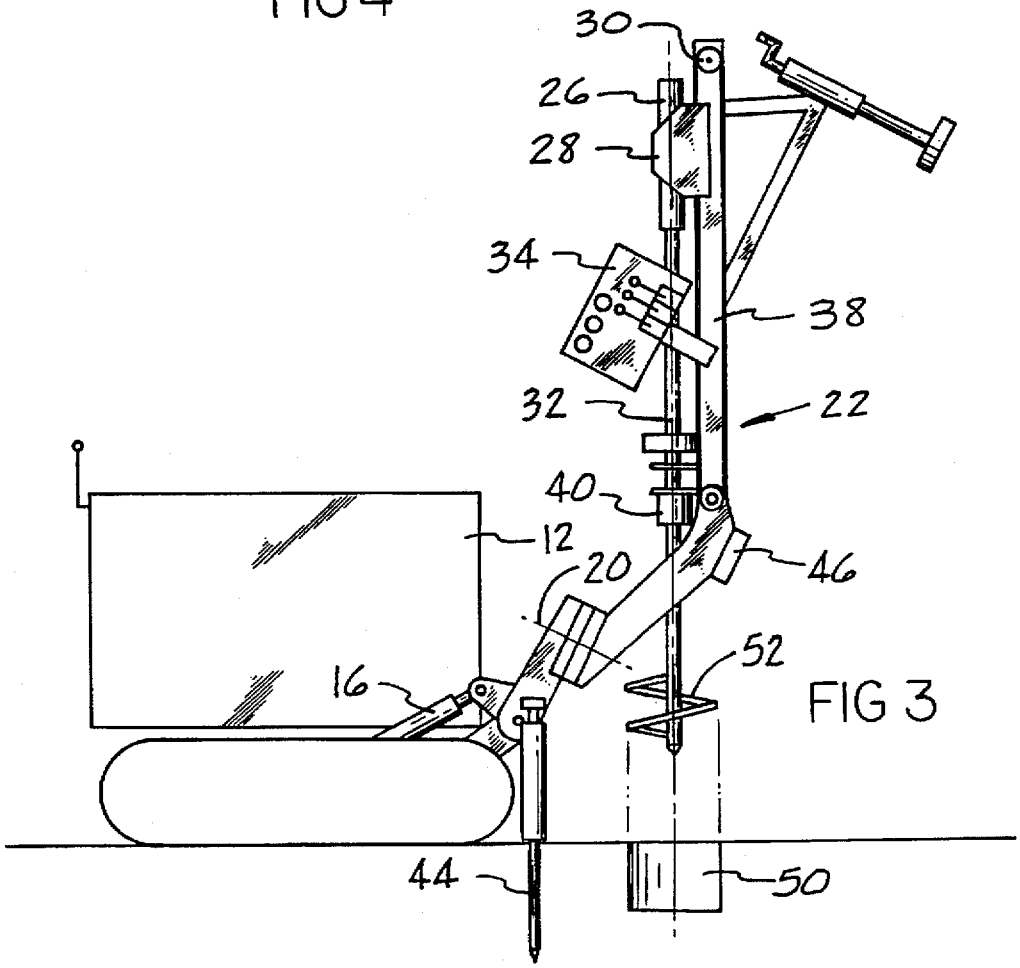
FIG. 3 is a side elevational view of the drilling machine with the drilling frame elevated to its vertical position.

The drill frame 22 is symbolically illustrated with the various components, all of which are old in the art and described in detail in FIG. 8 of U.S. Pat. No. 5,253,721. The drill frame 22 is supported and lifted by the support legs 24 in a cantilevered manner as best seen in FIG. 3. The drill frame 22 includes a carriage 28 which moves up and down the drill rack 38 through the action of a rotary hydraulic motor 30. The motor 30 drives a sprocket not shown which in turn pulls a chain 29 connected to carriage 28 for pulling the carriage either up or down the drill rack 38. Also mounted on carriage 28 is a hydraulic motor 26 which turns a spindle on the front of carriage 28 which in turn rotates sections of drill string 32. At the end of the drill string 32 is a drill head 36 which is turned by the drill string. Rotation of the drill string and thrusting of the carriage 28 are hydraulically controlled at panel 34 with the source of hydraulic energy, not shown, being provided from tractor 12. Located at the lower end of the drill rack, symbolically shown, are wrenches 54 and a guide 40 which assist in guiding the drill string and breaking the threaded joints between the various sections as described in detail in U.S. Pat. No. 5,231,899. Positioned at the lower end of the drill frame 22 is a support pad 46 which rests on the ground while the upper end of the drill frame is supported by a retractable support foot 48.

Figure 4:
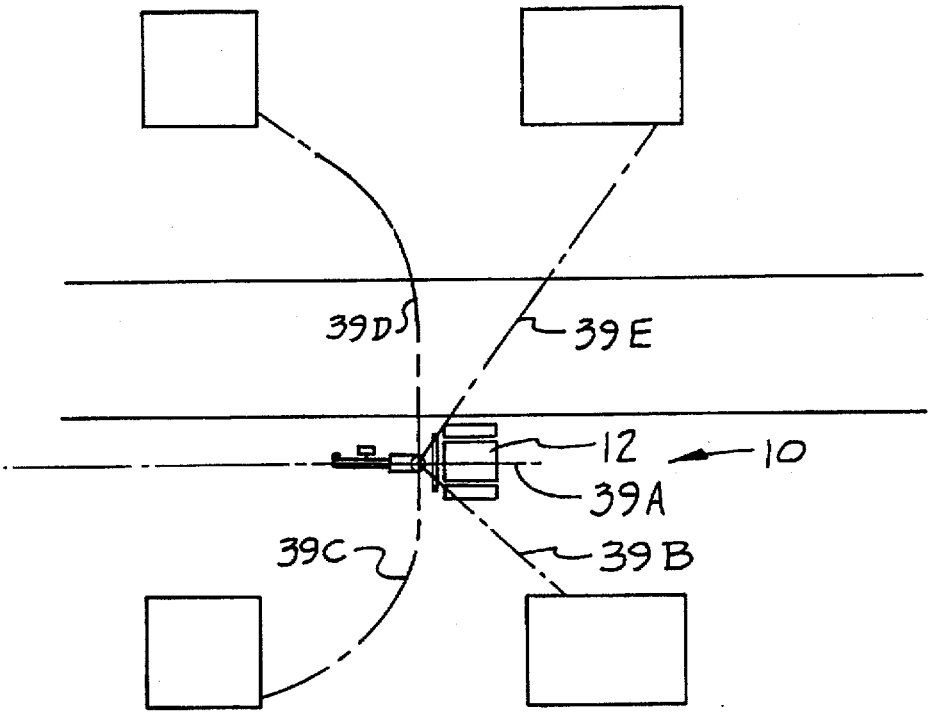
FIG. 4 is a plan view illustrating a typical multiple bore configuration.

Extending outwardly from the frame of the tractor 12 is an anchor bar 42 which supports a pair of anchor stakes 44. When the drilling machine 10 is in its transport mode the drill frame 22 is lifted upward by hydraulic cylinder 16 to its FIG. 3 position. The application of the multiple position drilling machine is illustrated in FIG. 4 wherein a single set-up permits the machine 10 to drill five or more bores with one set-up of the tractor. FIG. 4 illustrates four houses with four separate utility line **39*b*, 39*c*, 39*d* and 39*e* all joining at a common point. This single set-up could also provide a trunk line for the four houses in bore 39*a***.

FIG. 3 illustrates the drilling machine 10 with the drill frame in a vertical position and a large diameter auger bit 52 connected to the drill string 32 for digging the initial entry pit 50 which is optional.

OPERATION

After the entry pit 50 is dug, the drill frame 22 is tilted down to its angular position as shown in FIG. 1 and the auger bit is removed and replaced with a conventional directional drilling bit 36. While the angle in which the drill string enters the ground can be adjusted, it typically would be less than 30° as illustrated in FIG. 1. Cylinder 16 tilts the drill frame 22 until it contacts the ground at support pad 46 and support foot 48 in preparation for drilling. The anchor stakes 44 are put in place and the drilling operation of the first bore is commenced with the axis of the drill string 32 intersecting the vertical axis 21 of the pivoting joint 20. After the initial bore is drilled and withdrawn, the drill frame 22 is lifted off the ground and the frame is rotated, as seen in FIG. 2, from its solid line position to its dotted line position **39*b*. After the second bore 39*b* is completed the following bores 39*d*, 39*c* and 39*e* can also be drilled. In actuality, there are an infinite number of bores that can be drilled from a single set-up point with the only limitation being that the drill frame can only rotate through a horizontal path of 180°. The utility line, whether it be electricity, gas or water is typically pulled in from the opposite end of the bore back into the entry pit 50** whereupon the various connections to a trunk line can be made.

The drilling machine 10 can be used without an entry pit. The tractor 12 could be either tract mounted or rubber tires. The tractor could be a skid-loader or mounted on a backhoe.

While the invention has been described with a certain degree of particularity, it is manifest that changes may be made in the details of the drill frame and its components without departing from the spirit and scope of the disclosure. It is understood that the invention is not limited to the embodiment set forth herein, but is to be limited only by the scope of the attached claims including the full range of equivalence to which element is entitled.

I claim:

1. A multi-purpose directional drill which makes multiple bores in the ground through a common entry point from a single set-up position comprising:

a drilling rack having a drill rod axis which selectively thrusts and rotates the drill rod to control the direction of the bore, the drilling rack being angularly positioned with respect to the ground;

a movable base for supporting the drilling rack; and a pivotal joint between the drilling rack and the base providing horizontal movement of the drilling rack with the vertical axis of rotation of the pivotal joint positioned substantially over the common entry point.

2. The multi-position directional drill set forth in claim 1 wherein the vertical axis of rotation of the pivotal joint intersects the drill rod axis approximate the surface of the ground.

3. The multi-position directional drill as set forth in claim 2 wherein the base is a tractor having a tilting arm thereon pivotally attached thereto about a horizontal axis, the tilting arm is connected to the pivotal joint for supporting the drill rack, a linear actuating member connected to the tilting arm for rotating the drilling rack from its angular drilling position with the ground to a vertical drilling position.

4. The multi-position directional drill as set forth in claim 1 wherein the base is a tractor having a tilting arm thereon pivotally attached thereto about a horizontal axis, the tilting arm being connected to the pivotal joint for supporting the drill rack, and an actuating means connected to the tilting arm for rotating the drilling rack from its angular drilling position with the ground to a vertical drilling position.

5. The multi-position directional drill as set forth in claim 1 wherein the base is a tractor having a tilting arm thereon pivotally attached about a horizontal axis, the tilting arm is connected to the pivotal joint for supporting the drill rack, an actuating member connected to the tilting arm for rotating the drilling rack from its angular drilling position with the ground to a vertical drilling position further including a support means on the drill rack for supporting the drill rack on the ground in its angular drilling position, the drill rack being rotatable about its pivotal joint with the base to achieve an infinite number of drilling bore positions without moving the base.

6. The multi-position directional drill as set forth in claim 1 including anchor means on the base for transferring the thrust loading on the drill rack to the ground.

7. The multi-position directional drill as set forth in claim 1 wherein the drilling rack is free to swing though at least 180° of movement.

* * * * *